US005251822A

United States Patent [19]

Wang

[11] Patent Number: 5,251,822

[45] Date of Patent: Oct. 12, 1993

[54] SPRAY PAINT GUN

[76] Inventor: Hsing-Tzu Wang, No. 16, Industrial Dist., Chi Rd., Taichung City, Taiwan

[21] Appl. No.: 999,085

[22] Filed: Dec. 31, 1992

[51] Int. Cl.[5] ..... B05B 7/32

[52] U.S. Cl. ..... 239/346; 239/373; 239/375; 239/416.4

[58] Field of Search ..... 239/346, 373, 375, 364, 239/365, 290, 296, 416.4, 416.5, 417.3, 424

[56] References Cited

U.S. PATENT DOCUMENTS

| | | | |
|---|---|---|---|
| 968,210 | 8/1910 | Urbach | 239/365 X |
| 1,066,263 | 7/1913 | Von Dohn | 239/365 |
| 2,239,987 | 4/1941 | Bransen et al. | 239/290 X |
| 2,880,940 | 4/1959 | Briggs | 239/290 X |
| 2,959,358 | 11/1960 | Vork | 239/290 X |
| 3,722,818 | 3/1973 | Hayasaki et al. | 239/372 X |
| 4,901,925 | 2/1990 | Blake | 239/346 X |

*Primary Examiner*—Andres Kashnikow
*Assistant Examiner*—Kevin P. Weldon
*Attorney, Agent, or Firm*—Mason, Fenwick & Lawrence

[57] ABSTRACT

A spray paint gun has an air passage interconnecting an air chamber of the gun body and the interior of a paint container, and a valve device for opening and closing the air passage. The gun body has a blind bore connected to the air passage. The air passage has a first section extending from the air chamber to the blind bore, a second section extending from the blind bore to the exterior of a connecting portion, and a third section formed in the wall of a tubular member which is connected to the gun body. The third section of the air passage intercommunicates the second section of the air passage and the interior of the container. The valve device includes a threaded bolt screwed to the blind bore. A threaded rod is threaded through a central hole of the threaded bolt. The threaded rod has a first end connected with a knob and a second end extending out of the threaded bolt into the blind bore of the gun body. The second end of the threaded rod has a central receiving blind hole. A coiled spring member is received in the central receiving blind hole. A disc has a central shaft which is inserted into the central receiving blind hole of the threaded rod.

2 Claims, 8 Drawing Sheets

SPRAY PAINT GUN

BACKGROUND OF THE INVENTION

1. Field of the Invention

This invention relates to a spray paint gun, more particularly to a spray paint gun which has a valve device for controlling the access of the compressed air into a paint container.

2. Description of the Related Art

Referring to FIG. 1, a conventional spray paint gun 1 includes an elongated gun body (1A) and a handle (1C) which is connected to a compressed air source (not shown). The gun body (1A) has a first air passage (1B) and a blind hole 4 extending longitudinally and inwardly from the front end of the gun body (1A). The first air passage (1B) is connected to the compressed air source via the handle (1C). Therefore, compressed air may be directed to the front end of the gun body (1A). A trigger 2 is provided pivotally on the gun body (1A) for controlling the air flow of the compressed air. An air cap (3A) with two air channels (3A') is mounted to the front end of the gun body (1A) by means of a screw nut (3B). An air chamber (3C) is formed between the front end of the gun body (1A) and the air cap (3A). The air chamber (3C) is communicated with the first air passage (1B). A nozzle 5 has a first end, which is threaded to the open end of the blind hole 4, and a tapered second end which is received in the air cap (3A). The nozzle 5 has a central through hole (5A) and a spray needle 1 received therein for opening and closing the central through hole of the nozzle 5, as best illustrated in FIG. 1A. A plurality of holes (5 C) are formed in the tapered second end of the nozzle 5, which communicate the air chamber (3C) and the exterior of the gun body (1A). A connecting portion 6 has an externally threaded lower section (6B) which depends from a lower portion of the connecting portion 6. The externally threaded lower section (6B) of the connecting portion 6 is connected threadedly to an upper end of a tubular member 7. A paint container (T) is threaded to a lower end of the tubular member 7. The connecting portion 6 has a through bore (6A) that is communicated with the blind hole 4 of the gun body (1A). A pipe member 8 has a first end, which is inserted into the through bore (6A), and a second end which extends through the tubular member 7 and into the container (T). A second air passage 9 extends through the gun body (1A) and the connecting portion 6 in order to interconnect the air chamber (3C) and the interior of the container (T). The second air passage 9 has an internally threaded section (9B) adjacent to the air chamber (3C) and an outlet (9A) adjacent to the interior of the tubular member 7. The lower end of the tubular member 7 has a threaded hole (7A) in which a stop screw (7B) is threaded.

When in use, the trigger 2 is actuated to allow compressed air to flow through the first air passage (1B) of the gun body (1A) and to the air chamber (3C). The compressed air flows out of the gun body (1A) from the air channels (3B') of the air cap (3A) and the holes (5C) of the nozzle 5, as best illustrated in FIG. A, which is an enlarged view of the encircled portion (A) in FIG. 1. A part of the compressed air flows into the paint container (T) via the second air passage 9. Thus, the internal pressure of the paint container (T) will be increased to a sufficient value, thereby forcing paint in the paint container (T) to enter the blind hole 4 through the pipe member 8 and the through bore (6A). The paint will further flow to the central through hole (5A) of the nozzle 5 and will be dispersed into mist by means of the compressed air which flows through the air channels (3B') of the air cap (3A) and the holes (5C) of the nozzle 5. Since the paint in the paint container (T) is directed to the blind hole 4 of the gun body (1A) by means of the compressed air, a thicker paint may be used for spray painting.

If a thinner paint is to be used for spraying painting, the paint may be siphoned from the paint container (T) to the central hole (5A) of the nozzle 5, as best illustrated in FIG. 2. In this situation, the compressed air should be prevented from entering the second air passage 9. This can be accomplished by removing the screw nut (3B), the air cap (3A) and the nozzle 5, in this sequence, from the front end of the gun body (1A). The stop screw (7B) is then threaded from the threaded hole (7A) and threaded into the internally threaded section (9B) of the second air passage 9. The nozzle 5, the air cap (3A) and the screw nut (3B) are mounted, in this sequence, to the front end of the gun body (1A). Thus, the compressed air will flow through the holes (5C) of the nozzle 5 and the air channels (3A') of the air cap (3A) and will not enter the second air passage 9. Therefore, the paint can be directed to the blind hole 4 and is released from the gun body (1A) by means of the pressurized air force or the siphon force by opening or closing the second air passage 9 with the use of the stop screw (7B).

The conventional spray paint gun has the following disadvantages:

(1) Insertion and removal of the stop screw (7B) into and from the threaded section (9B) are troublesome operations.

(2) Since the stop screw (7B) is very small (the outer diameter and the length of the stop screw (7B) are both about 3 mm), the stop screw (7B) is liable to miss and can be damaged when threaded in the threaded section (9B) of the second air passage 9.

SUMMARY OF THE INVENTION

It is therefore a main object of this invention to provide a spray paint gun which has a valve device to open and close the second air passage. The valve device can be easily operated and will not miss and be damaged.

Accordingly, the spray paint gun of this invention comprises an elongated gun body with a front end. A first air passage and a blind hole extend longitudinally and inwardly from the front end of the gun body. The first air passage is connected to a compressed air source. An air cap is mounted to the front end of the gun body and an air chamber is formed between the air cap and the front end of the gun body. The air chamber is communicated with the first air passage. A nozzle has a first end threaded to an open end of the blind hole of the gun body and a tapered second end received in the air cap. The nozzle has a central through hole and a spray needle received therein for opening and closing the central through hole of the nozzle. A connecting portion has an externally threaded lower section which depends from a lower portion of the gun body. The externally threaded section of the connecting portion is connected threadedly to a tubular member. A paint container is connected to the tubular member. The connecting portion has a through bore communicated with the blind hole of the gun body. A pipe member has a first end inserted in the through bore of the connecting portion and a second end extending through the tubular member into the interior of the container. The gun body further has a second air passage interconnecting the air chamber and the interior of the container and a valve device for closing and opening the second air passage.

The gun body has a blind bore with a flat bottom connected to the second air passage. The blind bore has an internal thread. The second air passage has a first section extending from the air chamber to the bottom of the blind bore, a second section extending from the blind bore to the exterior of the connecting portion, and a third section formed in the wall of the tubular member. The third section of the second air passage intercommunicates the second section of the second air passage and the interior of the container.

The valve device includes a threaded bolt with a shank, a head connected to the shank and a central hole formed through the head and the shank of the threaded bolt so that an opening is formed at the free end of the shank. The threaded bolt is screwed to the blind bore. The central hole of the threaded bolt has a first section which is adjacent to the head of the threaded bolt and which is provided with an internal thread, and a second section which has a diameter that is larger than the diameter of the first section of the central hole. The threaded bolt has a vent hole interconnecting the exterior of the threaded bolt and the second section of the central hole of the threaded bolt. A threaded rod is screwed to the first section of the central hole of the threaded bolt. The threaded rod has a first end connected with a knob and a second end extending out of the threaded bolt into the blind bore of the gun body. The second end of the threaded rod has a central receiving blind hole. A coiled spring member is received in the central receiving blind hole. A disc has a central shaft connected perpendicularly thereto. The central shaft is inserted into the central receiving blind hole of the threaded rod. The disc has a diameter this is smaller than the diameter of the blind bore of the gun body. The threaded rod is moved between a first position, wherein the second end of the threaded rod pushes the disc to abut the bottom of the blind bore in order to close the first section of the second air passage, and a second position, wherein the second end of the threaded rod abuts the free end of the shank of the threaded bolt in order to close the opening of the shank of the threaded bolt and wherein the disc abuts the bottom of the blind hole in order to close the first section of the second air passage by means of the biasing force of the coiled spring.

Other features and advantages of this invention will become apparent in the following detailed description of a preferred embodiment of this invention with reference to the accompanying drawings.

DETAILED DESCRIPTION OF THE PREFERRED EMBODIMENT

Figure 1:
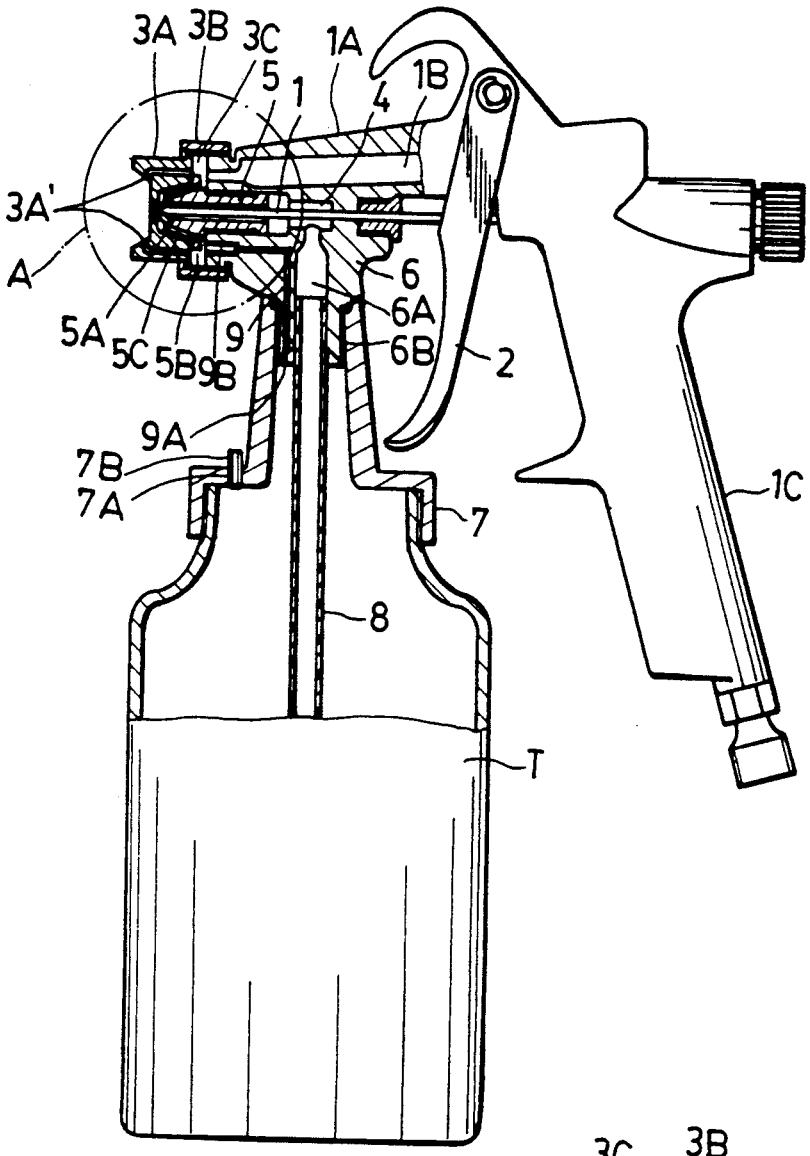
FIG.1 PRIOR ART
FIG. 1 is a partly sectional perspective view of a conventional spray paint gun.
Figure 1A:
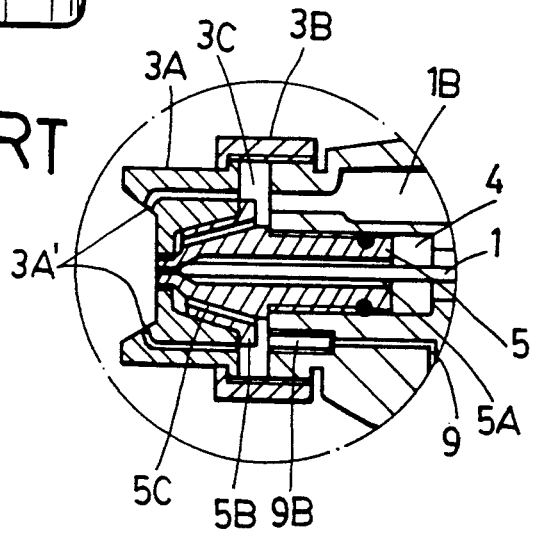
FIG.1A PRIOR ART
FIG. 1A is a sectional view of the encircled portion (A) of FIG. 1.
Figure 2:
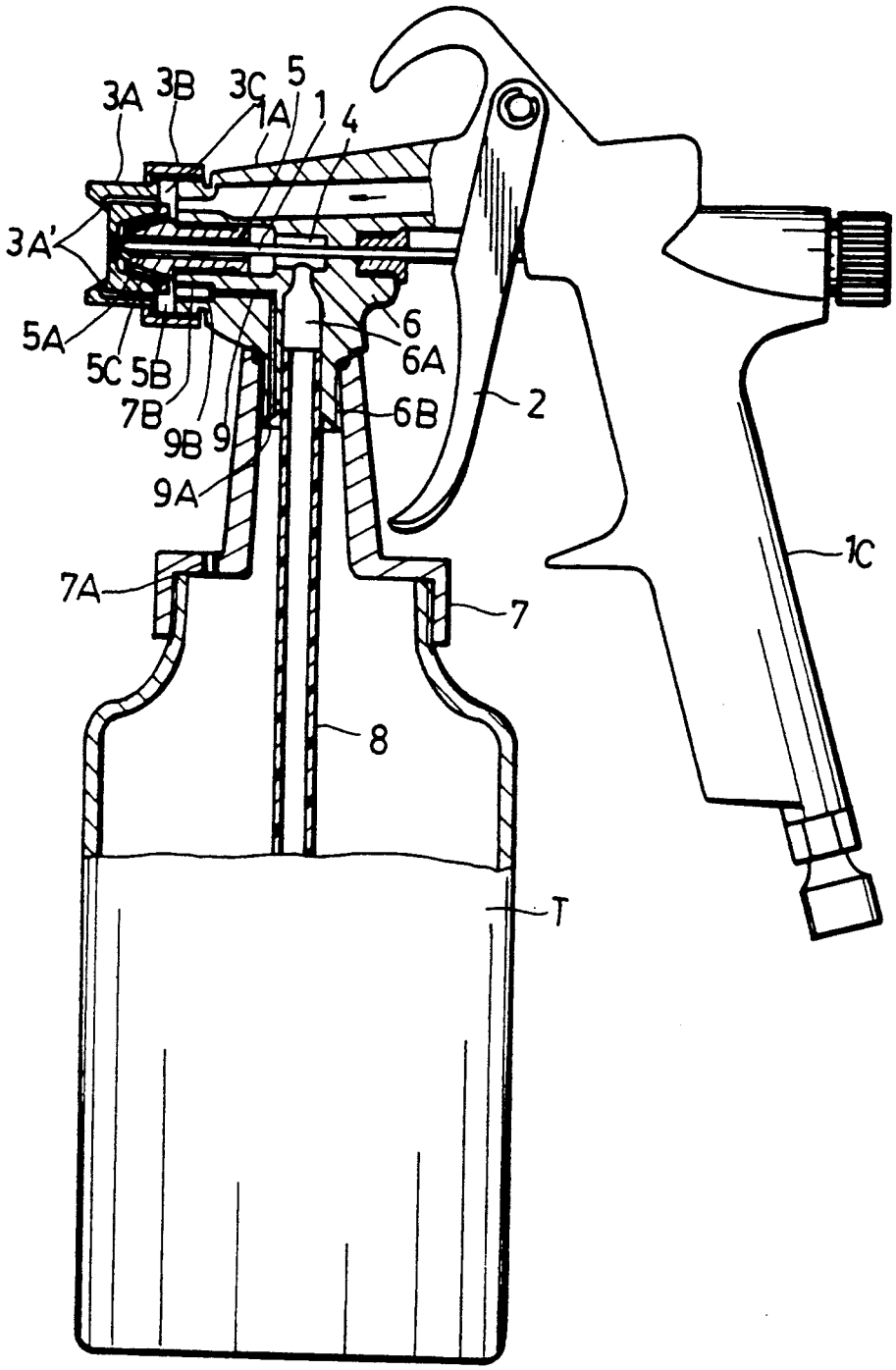
FIG.2 PRIOR ART
FIG. 2 is a partly sectional schematic view illustrating the conventional spray paint gun when in use.
Figure 3:
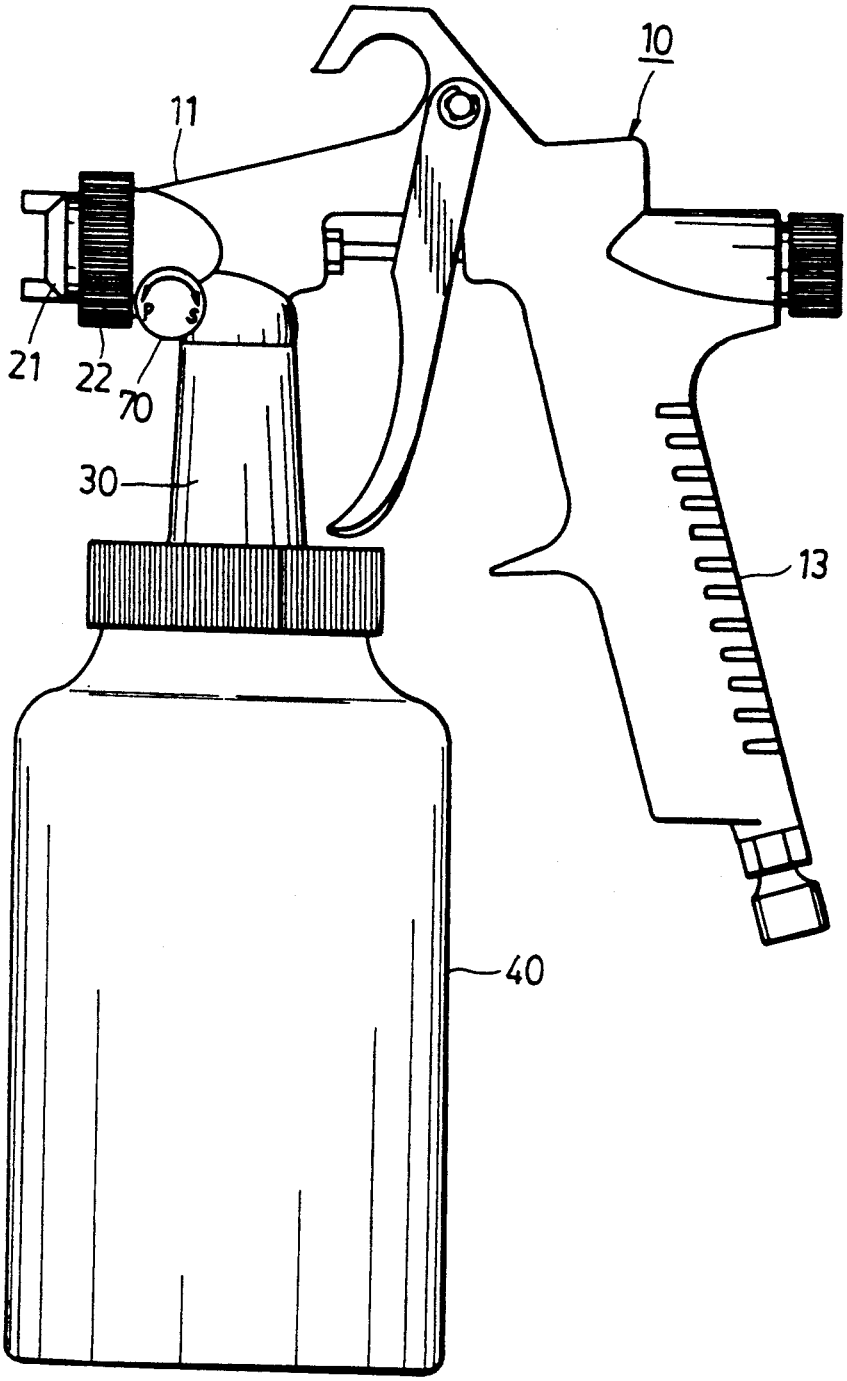
FIG. 3 is a perspective view of a preferred embodiment of a spray paint gun of this invention.
Figure 7:
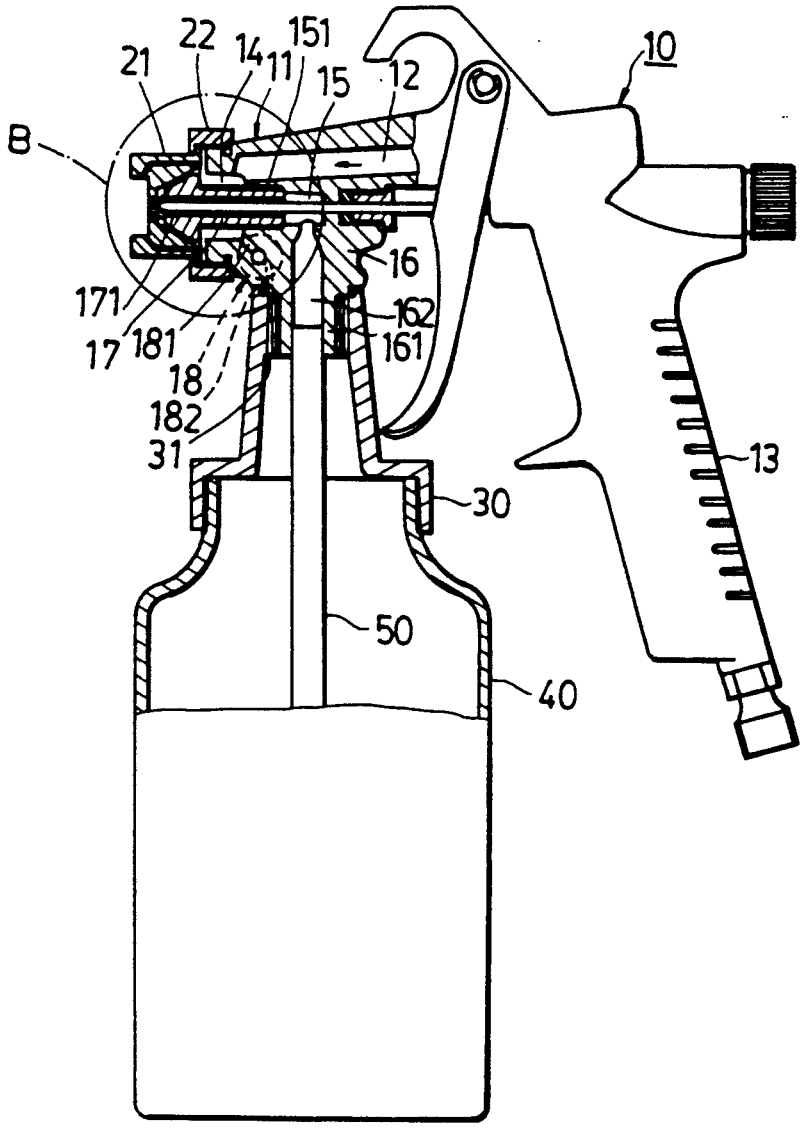
FIG. 7 is a partially sectional view of the spray paint gun of this invention.
Figure 7A:
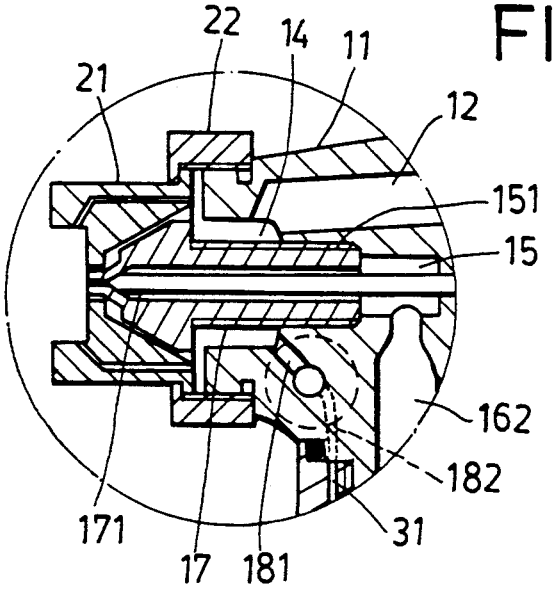
FIG. 7A is an enlarged view of the encircled portion (B) of FIG. 7.

FIGS. 3 and 7 show a preferred embodiment of a spray paint gun 10 of this invention. The spray paint gun 10 includes an elongated gun body 11 and a handle 13 which is connected to a compressed air source (not shown). The gun body 11 has a first air passage 12 and a blind hole 15 extending longitudinally and inwardly from the front end of the gun body 11. An air cap 21 is mounted to the front end of the gun body 11 by means of a screw nut 22. An air chamber 14 is formed between the front end of the gun body 11 and the air cap 21. A nozzle 17 has a first end threaded to the stepped open end 151 of the blind hole 15 of the gun body 11 and a second end received in the air cap 21. The nozzle 17 has a central through hole 171, as best illustrated in FIG. 7A. A connecting portion 16 has an externally threaded lower section 161 which depends from a lower portion of the connecting portion 16. The externally threaded lower section 161 of the connecting portion 16 is connected threadedly to a tubular member 30. A paint container 40 is threaded to the tubular member 30. The connecting portion 16 has a through bore 162 that is communicated with the blind hole 15 of the gun body 11. A pipe member 8 has a first end which is inserted into the through bore 162 and a second end which extends through the tubular member 30 and into the container 40. The aforementioned structure of the spray paint gun 10 of this invention is similar to that of the conventional spray paint gun and is not the feature of this invention.

A second air passage 18 extends through the gun body 11 and the connecting portion 16 in order to interconnect the air chamber 14 and the interior of the container 40. A valve device 70 is provided to close and open the second air passage 18.

Figure 4:
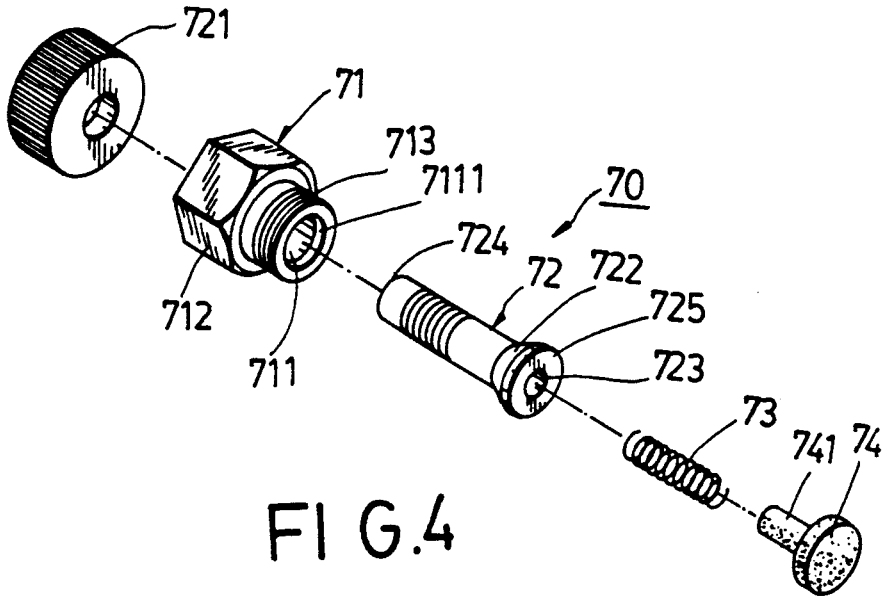
FIG. 4 is a perspective exploded view of the valve device of the spray paint gun of this invention.
Figure 5:
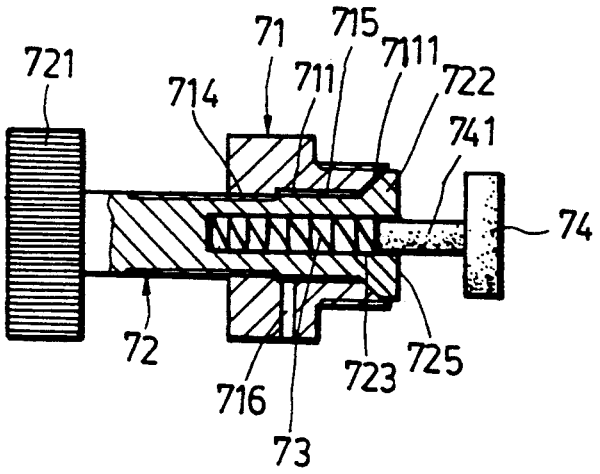
FIG. 5 is a perspective view of the valve device of the spray paint gun of this invention.
Figure 6:
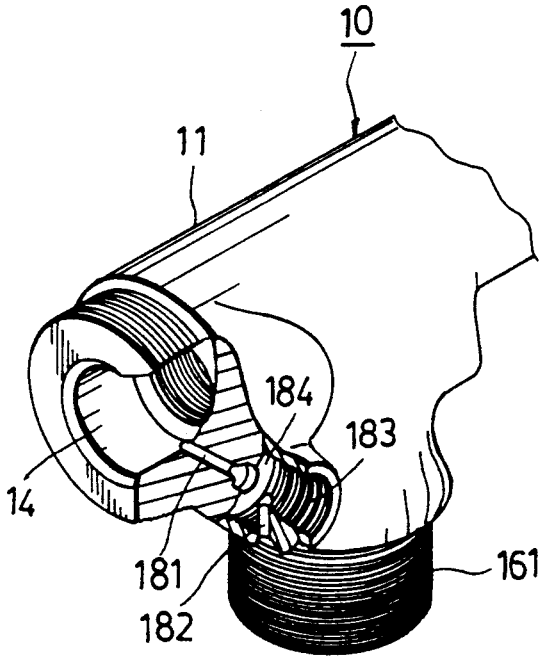
FIG. 6 is a fragmentary perspective view of the second air passage of the spray paint gun of this invention.
Figure 8:
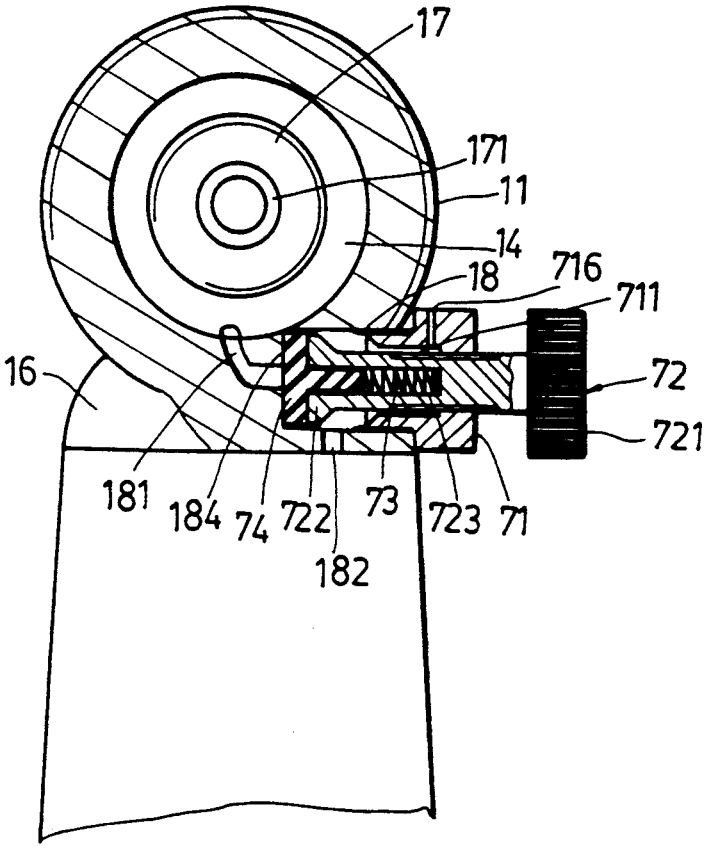
FIG. 8 is a cross sectional view of the spray paint gun of this invention.
Figure 9A:
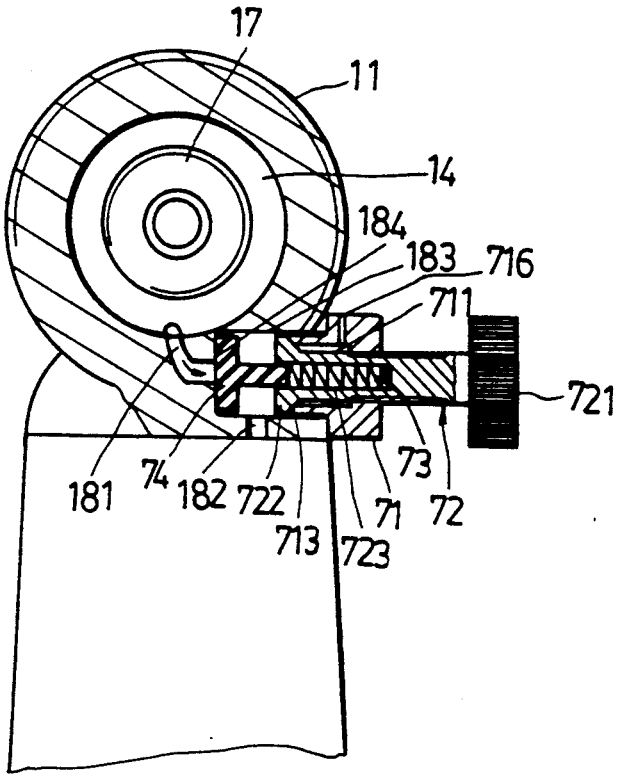
FIG. 9A is a cross sectional schematic view illustrating the spray paint gun in a first operative position.
Figure 9B:
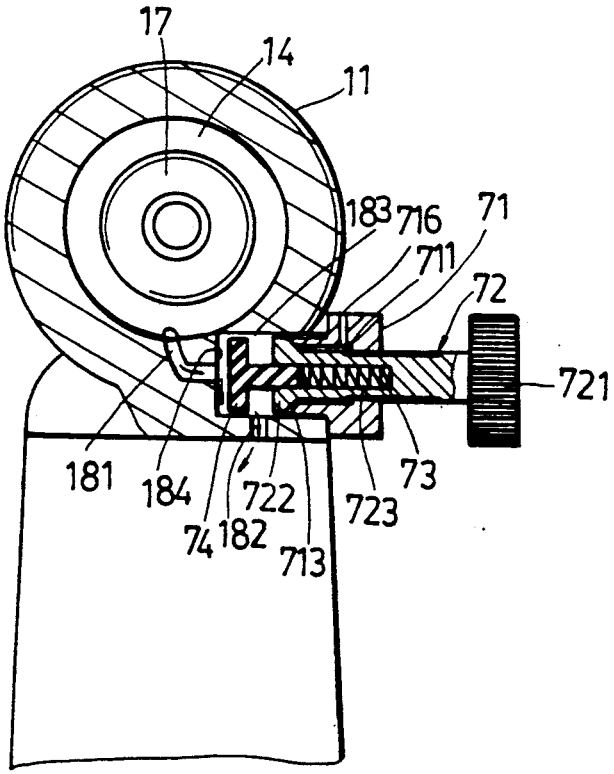
FIG. 9B is a cross sectional schematic view illustrating the spray paint gun in a second operative position.

Referring to FIG. 6, the gun body 11 has a blind bore 183 with a flat bottom 184 extending to the second air passage 18. The blind bore 183 has an internal thread. The second air passage 18 has a first section 181 extending from the air chamber 14 to the bottom 184 of the blind bore 183, a second section 182 extending from the blind bore 183 to the exterior of the connecting portion 16, and a third section 31 formed in the wall of the tubular member 30. The third section 31 of the second air passage 18 intercommunicates the second section 182 of the second air passage 18 and the interior of the container 40. Referring to FIGS. 4 and 5, the valve device 70 includes a threaded bolt 71 with a shank 713, a head 712 connected to the shank 713 and a central hole 711 formed through the head 712 and the shank 713 of the threaded bolt 71 so that an opening 7111 is formed at the free end of the shank 713. The threaded bolt 71 is screwed to the blind bore 183. The central hole 711 of the threaded bolt 71 has a first section 714, which is adjacent to the head 712 of the threaded bolt 71 and which is provided with an internal thread, and a second section 715 which has a diameter that is larger than the diameter of the first section 714 of the central hole 711. The threaded bolt 71 has a vent hole 716 interconnecting the exterior of the threaded bolt 71 and the second section 715 of the central hole 711 of the threaded bolt 71. A threaded rod 72 is screwed to the first section 714 of the central hole 711 of the threaded bolt 71. The threaded rod 72 has a first end 724 connected with a knob 721 and a second end 725 extending out of the threaded bolt 71 into the blind bore 183 of the gun body 11. The second end 725 of the threaded rod 72 has a central receiving blind hole 723. A coiled spring member 73 is received in the central receiving blind hole 723. A disc 74 has a central shaft 741 connected perpendicularly thereto. The central shaft 741 is inserted into the central receiving blind hole 723 of the threaded rod 72. The disc 74 has a diameter that is smaller than the diameter of the blind bore 183 of the gun body 11. The threaded rod 72 is moved between a first position, as best illustrated in FIG. 8, wherein the second end 725 of the threaded rod 72 pushes the disc 74 to abut the bottom 184 of the blind bore 183 in order to close the first section 181 of the second air passage 18, and a second position, as best illustrated in FIGS. 9A and 9B, wherein the second end 725 of the threaded rod 72 abuts the free end of the shank 713 of the threaded bolt 71 in order to close the opening 7111 of the shank 713 of the threaded bolt 71 and wherein the disc 74 abuts the bottom 184 of the blind hole 183 in order to close the first section 181 of the second air passage 18 by means of the biasing force of the coiled spring 73. The opening in the free end of the threaded bolt 71 is in the shape of a truncated cone, while the second end 725 of the threaded rod 72 is shaped correspondingly as a truncated cone. Therefore, when the threaded rod 72 is moved to the second position, the opening 7111 of the threaded bolt 72 can be closed in an air-tight manner.

When the knob 721 is rotated clockwise in order to move the threaded rod 72 to the first position, the second air passage 18 is blocked and the compressed air can not enter the paint container 40. Therefore, the paint in the paint container is siphoned from the paint container 40 to the central hole 171 of the nozzle 5, through the pipe member 50, the through bore 161 of the connecting portion 16 and the blind hole 15 of the gun body 11, as best illustrated in FIG. 8. The interior of the paint container 40 is communicated with the exterior of the paint container 40 by means of the third section 31 of the tubular member 30, the second section 182, the central hole 711 and the vent hole 716 of the threaded bolt 71.

When the knob 721 is rotated counterclockwise in order to move the threaded rod 72 to the second position, the second air passage 18 is blocked resiliently by the disc 74. The compressed air can enter the paint container 40 to force the thicker paint in the paint container 40 to flow to the central hole 171 of the nozzle 5, through the pipe member 50, the through bore 161 of the connecting portion 16 and the blind hole 15 of the gun body 11, as best illustrated in FIG. 9B. When the spray paint gun 10 is not in use and the compressed air is not supplied thereto, the disc 74 will block the first section 181 of the second air passage 18, and thus, the air pressure of the paint container 40 may be maintained at a high pressure value. Therefore, when the spray paint gun 10 is in use, there will be no pressure difference between the air chamber 14 and the paint container 40. No time lag will occur between two discontinuous applications of the spray paint gun 10 of the present invention.

Note that the valve device 70 of this invention can be easily operated without damage to the valve device 70. In addition, since the second air passage 18 of this invention is formed with three short sections, these sections can be easily cleaned when blocked by paint.

With this invention thus explained, it is apparent that numerous modifications and variations can be made without departing from the scope and spirit of this invention. It is therefore intended that this invention be limited only as indicated in the appended claims.

I claim:

1. A spray paint gun having an elongated gun body with a front end, said gun body having a first air passage and a blind hole extending longitudinally and inwardly from said front end of said gun body, said first air passage being connected to a compressed air source, an air cap being mounted to said front end of said gun body, an air chamber formed between said air cap and said front end of said gun body, said air chamber being communicated with said first air passage, a nozzle having a first end threaded to an open end of said blind hole of said gun body and a tapered second end received in said air cap, said nozzle having a central through hole and a spray needle received therein for opening and closing said central through hole of said nozzle, a connecting portion with an externally threaded lower section depending from a lower portion of said gun body, said externally threaded section of said connecting portion being connected threadedly to a tubular member with a wall, a paint container being connected to said tubular member, said connecting portion having a throughbore communicated with said blind hole of said gun body and a pipe member with a first end inserted in said through bore of said connecting portion and a second end extending through said tubular member into the interior of said container, said gun body further having a second air passage interconnecting said air chamber and said interior of said container and a valve device for closing and opening said second air passage, whereby paint in said container can be directed to said blind hole of said gun body through said pipe member and can be dispersed into mist through said center through hole of said nozzle so as to be sprayed out of said nozzle with the aid of compressed air which comes from said compressed air source through said first air passage and said air chamber;

the improvements comprising:

said gun body having a blind bore with a flat bottom connected to said second air passage, said blind bore having an internal thread formed adjacent to an open end of said blind bore;

said second air passage having a first section extending from said air chamber to said bottom of said blind bore, a second section extending from said blind bore to the exterior of said connecting portion, and a third section formed in said wall of said tubular member, said third section of said second air passage intercommunicating said second section of said second air passage and the interior of said container; and said valve device including a threaded bolt with a shank, a head connected to said shank and a central hole formed through said head and said shank of said threaded bolt so that an opening is formed at a free end of said shank, said threaded bolt being screwed to said internal thread of said blind bore with said free end of said shank being received in said blind hole and being spaced from said bottom of said blind hole at a predetermined distance, said central hole of said threaded bolt having a first section which is adjacent to said head of said threaded bolt and which is provided with an internal thread, and a second section which has a diameter that is larger than the diameter of said first section of said central hole, said threaded bolt having a vent hole interconnecting the exterior of said threaded bolt and said second section of said central hole of said threaded bolt, a threaded rod screwed to said first section of said central hole of said threaded bolt, said threaded rod having a first end connected with a knob and a second end extending out of said threaded bolt into said blind bore of said gun body, said second end of said threaded rod having a central receiving blind hole, a coiled spring member being received in said central receiving blind hole, a disc having a central shaft connected perpendicularly thereto, said central shaft being inserted into said central receiving blind hole of said threaded rod, said disc having a diameter that is smaller than the diameter of said blind bore of said gun body, said threaded rod being moved between a first position, wherein said second end of said threaded rod pushes said disc to abut said bottom of said blind bore in order to close said first section of said second air passage, and a second position, wherein said second end of said threaded rod abuts the free end of said shank of said threaded bolt in order to close said opening of said shank of said threaded bolt and wherein said disc abuts said bottom of said blind hole in order to close said first section of said second air passage by means of the biasing force of said coiled spring.

2. A spray paint gun as claimed in claim 1, wherein said opening of said free end of said threaded bolt is shaped as a truncated cone, and the second end of said threaded rod is shaped correspondingly as a truncated cone.

* * * * *